US011051597B2

(12) United States Patent
Smith

(10) Patent No.: US 11,051,597 B2
(45) Date of Patent: Jul. 6, 2021

(54) CARRYING CASE WITH ADJUSTABLE VIEWING STAND

(71) Applicant: R.D.S. Industries, Inc., Torrance, CA (US)

(72) Inventor: Richard D. Smith, Fountain Hills, AZ (US)

(73) Assignee: R.D.S. INDUSTRIES, INC., Torrance, CA (US)

( * ) Notice: Subject to any disclaimer, the term of this patent is extended or adjusted under 35 U.S.C. 154(b) by 0 days.

(21) Appl. No.: 16/887,728

(22) Filed: May 29, 2020

(65) Prior Publication Data

US 2020/0288836 A1 Sep. 17, 2020

Related U.S. Application Data

(63) Continuation of application No. 16/431,659, filed on Jun. 4, 2019, now Pat. No. 10,702,033.

(60) Provisional application No. 62/785,609, filed on Dec. 27, 2018.

(51) Int. Cl.

| | |
|---|---|
| ***A45C 13/02*** | (2006.01) |
| ***A45C 11/00*** | (2006.01) |
| ***A45C 13/10*** | (2006.01) |

(52) U.S. Cl.

CPC ..... *A45C 13/02* (2013.01); *A45C 13/103* (2013.01); *A45C 2011/003* (2013.01); *A45C 2200/15* (2013.01)

(58) Field of Classification Search

CPC ..... A45C 2011/002; A45C 2011/003; A45C 2200/15; A45C 13/002; A45C 2013/025; G06F 1/166; G06F 1/1641

See application file for complete search history.

(56) References Cited

U.S. PATENT DOCUMENTS

| | | | | |
|---|---|---|---|---|
| 5,927,673 | A | 7/1999 | Kurokawa et al. | |
| 6,663,072 | B1 * | 12/2003 | Ritchey | A45C 3/02 248/346.03 |
| 6,967,836 | B2 | 11/2005 | Huang et al. | |
| 7,561,415 | B2 | 7/2009 | Liou et al. | |
| 8,312,991 | B2 | 11/2012 | Diebel et al. | |
| 8,328,008 | B2 | 12/2012 | Diebel et al. | |
| 8,434,601 | B2 | 5/2013 | Hou et al. | |

(Continued)

FOREIGN PATENT DOCUMENTS

| | | |
|---|---|---|
| GB | 2489190 A | 9/2012 |
| GB | 2500315 A | 9/2013 |

(Continued)

OTHER PUBLICATIONS

It Came From A Box YouTube channel posted on Sep. 28, 2018 featuring a Tomtoc brand Nintendo Switch Hard Storage Case, shown at time stamp 2:18 through 3:27, https://www.youtube.com/watch?v=Nphss18N9Ac (Year: 2018).*

*Primary Examiner* — Mollie Impink

(74) *Attorney, Agent, or Firm* — Marshall A. Lerner; Brad Mattes; Kleinberg & Lerner, LLP

(57) ABSTRACT

A carrying case for a portable electronic device includes an adjustable viewing stand for supporting the electronic device at an angle selected by the user, the adjustable viewing stand comprising at least two panels hingably connected to one another and foldable so as to be able to reside inside the carrying case when the carrying case is closed and the carrying case comprising at least one subwell.

13 Claims, 10 Drawing Sheets

(56) References Cited

U.S. PATENT DOCUMENTS

| | | | | |
|---|---|---|---|---|
| 8,459,453 | B2 | 6/2013 | Parker et al. | |
| 8,708,140 | B2 | 4/2014 | Liu | |
| 8,763,795 | B1 | 7/2014 | Oten et al. | |
| 8,875,879 | B2 | 11/2014 | Diebel et al. | |
| 8,887,902 | B1 | 11/2014 | Liu | |
| 8,887,903 | B2 | 11/2014 | Diebel et al. | |
| 8,925,721 | B2 | 1/2015 | Young | |
| 8,925,722 | B2 | 1/2015 | Poon et al. | |
| D723,804 | S | 3/2015 | Coleman | |
| D730,912 | S | 6/2015 | Liu | |
| 9,095,194 | B2 | 8/2015 | Hassett | |
| D737,827 | S | 9/2015 | Tseng | |
| D739,142 | S | 9/2015 | Coleman | |
| D741,867 | S | 10/2015 | Liu | |
| D750,085 | S | 2/2016 | Hsu et al. | |
| D750,634 | S | 3/2016 | Langheim | |
| D753,125 | S | 4/2016 | Hsu et al. | |
| 9,382,033 | B2 | 7/2016 | Poon et al. | |
| 9,400,520 | B2 | 7/2016 | Igarashi | |
| 9,417,662 | B1 | 8/2016 | Feng | |
| 9,490,859 | B2 | 11/2016 | Peel | |
| 9,591,905 | B2 | 3/2017 | Poon et al. | |
| 9,603,425 | B2 | 3/2017 | Diebel et al. | |
| 9,661,906 | B2 | 5/2017 | Diebel et al. | |
| D797,108 | S | 9/2017 | Liu | |
| 9,813,533 | B1 | 11/2017 | Ye | |
| 9,826,075 | B2 | 11/2017 | Langhein | |
| D808,168 | S | 1/2018 | Turczynskyj | |
| 9,948,120 | B2 * | 4/2018 | Chan | G06F 1/1632 |
| D822,996 | S | 7/2018 | Ehara et al. | |
| 10,085,531 | B2 | 10/2018 | Diebel et al. | |
| 10,206,471 | B2 | 2/2019 | Hemesath | |
| D845,307 | S | 4/2019 | Hallar et al. | |
| 2004/0134813 | A1 * | 7/2004 | Domotor | A45C 3/02 206/320 |
| 2005/0231930 | A1 | 10/2005 | Jao | |
| 2011/0266194 | A1 | 11/2011 | Bau | |
| 2012/0153116 | A1 | 6/2012 | Harrison | |
| 2013/0233731 | A1 * | 9/2013 | Hsu | A45C 11/00 206/45.23 |
| 2013/0277271 | A1 | 10/2013 | Toulotte | |
| 2014/0291174 | A1 | 10/2014 | Chung | |
| 2014/0291175 | A1 | 10/2014 | Chung et al. | |
| 2015/0115125 | A1 | 4/2015 | Hou et al. | |
| 2016/0045003 | A1 | 2/2016 | Chen | |
| 2018/0352925 | A1 | 12/2018 | Hemesath | |
| 2018/0375980 | A1 | 12/2018 | Renfrow et al. | |

FOREIGN PATENT DOCUMENTS

| | | | |
|---|---|---|---|
| KR | 20030004385 | A | 1/2003 |
| KR | 100831137 | | 5/2008 |
| KR | 10-1944484 | | 1/2019 |
| KR | 1019444840000 | B1 | 1/2019 |
| WO | WO-02070373 | A1 | 9/2002 |
| WO | WO-2014008883 | A1 | 1/2014 |
| WO | WO-2016021946 | A2 | 2/2016 |
| WO | WO-2016092012 | A1 | 6/2016 |
| WO | WO-2018187847 | A1 | 10/2018 |

* cited by examiner

CARRYING CASE WITH ADJUSTABLE VIEWING STAND

BACKGROUND OF THE INVENTION

1. Field of the Invention

The present invention relates to a carrying case for a handheld or tabletop electronic device where the carrying case includes an adjustable stand that can support an electronic device, the electronic device typically has a viewing screen, and the carrying case has one or more subwells to accommodate feet that extend from the electronic device.

2. Description of the Related Art

The related art may include covers and cases for electronic devices where the cover or case includes means for selecting and controlling the angle at which the electronic device is positioned for viewing while in use. See for example, U.S. Pat. No. 5,927,673 (Kurokawa), U.S. Pat. No. 7,561,415 (Liou), U.S. Pat. No. 8,328,008 (Diebel), U.S. Pat. No. 8,887,903 (Diebel), U.S. Pat. No. 9,661,906 (Diebel), D737,827 (Tseng), D741,867 (Liu), and D750,634 (Langhein). Two panels that form an angle in a carrying case are shown in D822,996 (Dhara). None of this prior art, however, discloses a clamshell style carrying case that includes an adjustable stand in combination with any subwell. Dhara discloses a clamshell style carrying case that includes a pair of panels for holding parts and pieces. The Dhara panels, however, are not adjustable and they are not suitable to act as a stand for an electronic device.

SUMMARY OF THE INVENTION

The invention described herein is a carrying case with an adjustable viewing stand and one or more subwells. The carrying case is typically a clamshell style case used for carrying an electronic device such as a Nintendo Switch. The adjustable viewing stand ("stand") is located inside the carrying case and operates in connection with the carrying case. The subwells are located in an inner surface of the carrying case and are of two types, namely, (1) outer subwells that are configured to accept feet that extend from the electronic device and (2) central subwells that are adapted to hold card cases, tools, parts, and/or accessories or the like.

The stand has a surface adapted to support the electronic device and the electronic device typically has a viewing screen. The stand allows the angle of this surface to be adjusted with respect to the carrying case. In this manner, the stand controls the angle at which the electronic device is supported and viewed. This has several benefits including elimination of glare to enhance the crispness of the viewing screen.

BRIEF DESCRIPTION OF THE DRAWINGS

By way of example only, selected embodiments and aspects of the present invention are described below. Each such description refers to a particular figure ("FIG.") which shows the described matter. All such figures are shown in drawings that accompany this specification. Each such figure includes one or more reference characters that identify one or more part(s), element(s) or component(s) of the invention.

DESCRIPTION OF PREFERRED EMBODIMENT

The invention will now be described with reference to the embodiments shown in FIGS. 1 through 10.

Figure 7:
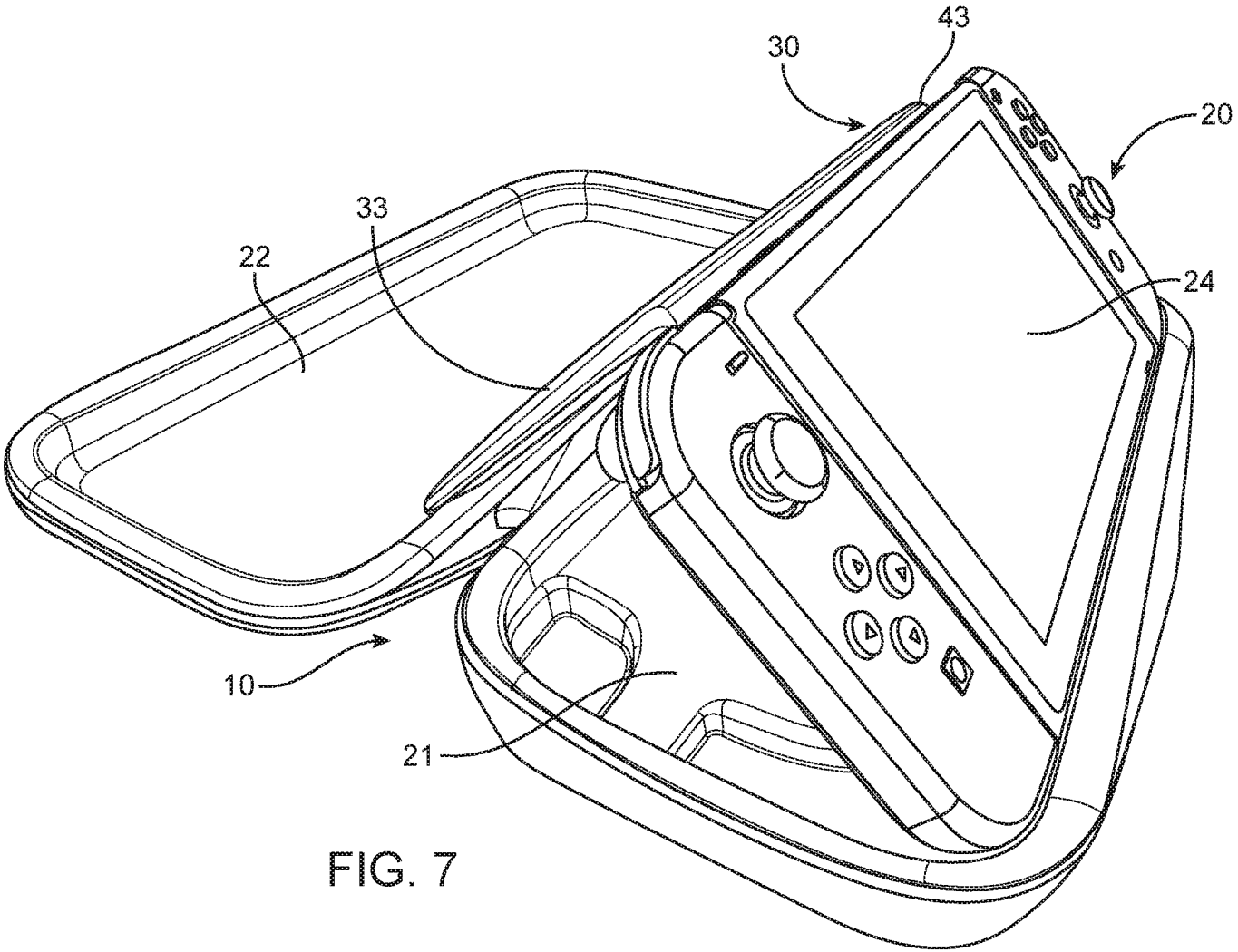
FIG. 7 is a perspective view of FIG. 6 where an electronic device has been placed on the viewing surface of the adjustable viewing stand.

One embodiment of the instant invention, a carrying case 10 with an adjustable viewing stand 30, is shown in FIG. 7. The carrying case 10 typically carries an electronic device 20 that has a viewing screen 24, an example of which is shown in FIG. 7. The back side of the electronic device 20 cannot be seen in FIG. 7, but the viewing stand 30 has a viewing surface 35 (shown in FIG. 4) which is in contact with the back side of the electronic device 20 and supports the electronic device 20.

Figure 1:
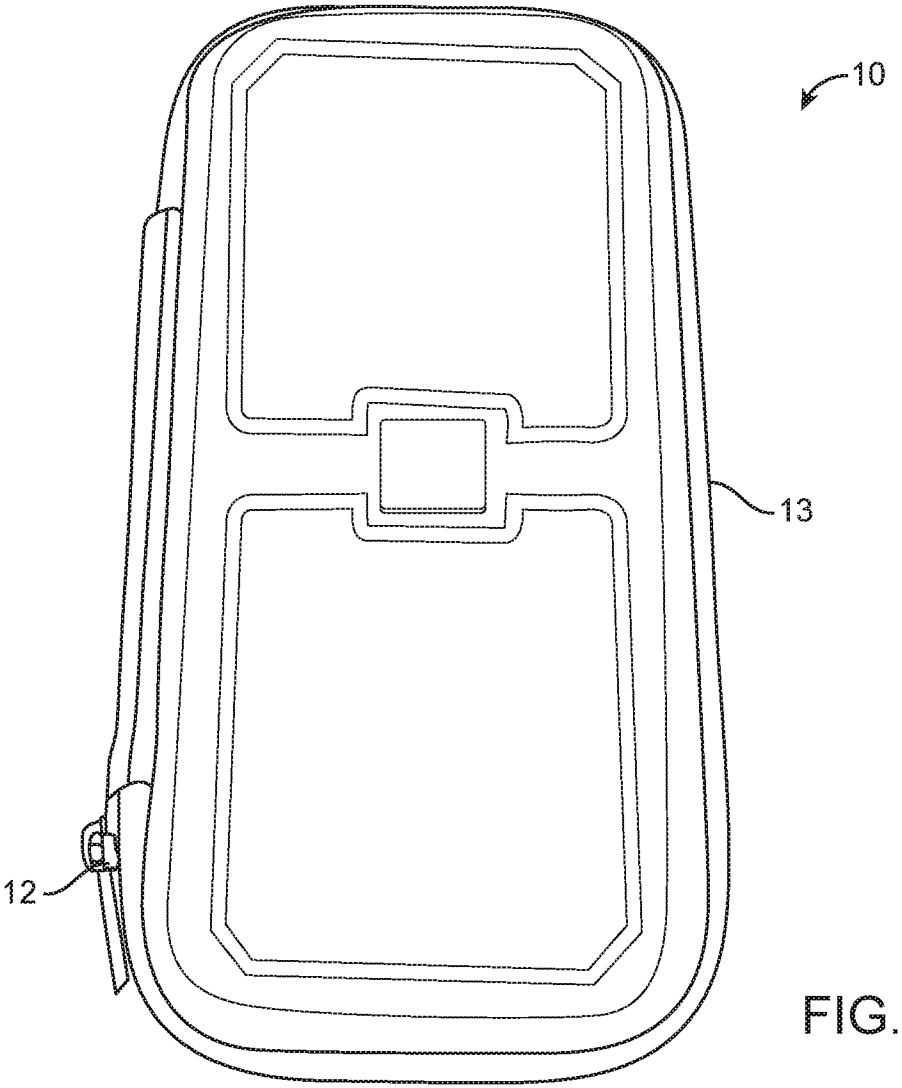
FIG. 1 shows a clamshell style carrying case for an electronic device where the case is closed.
Figure 5:
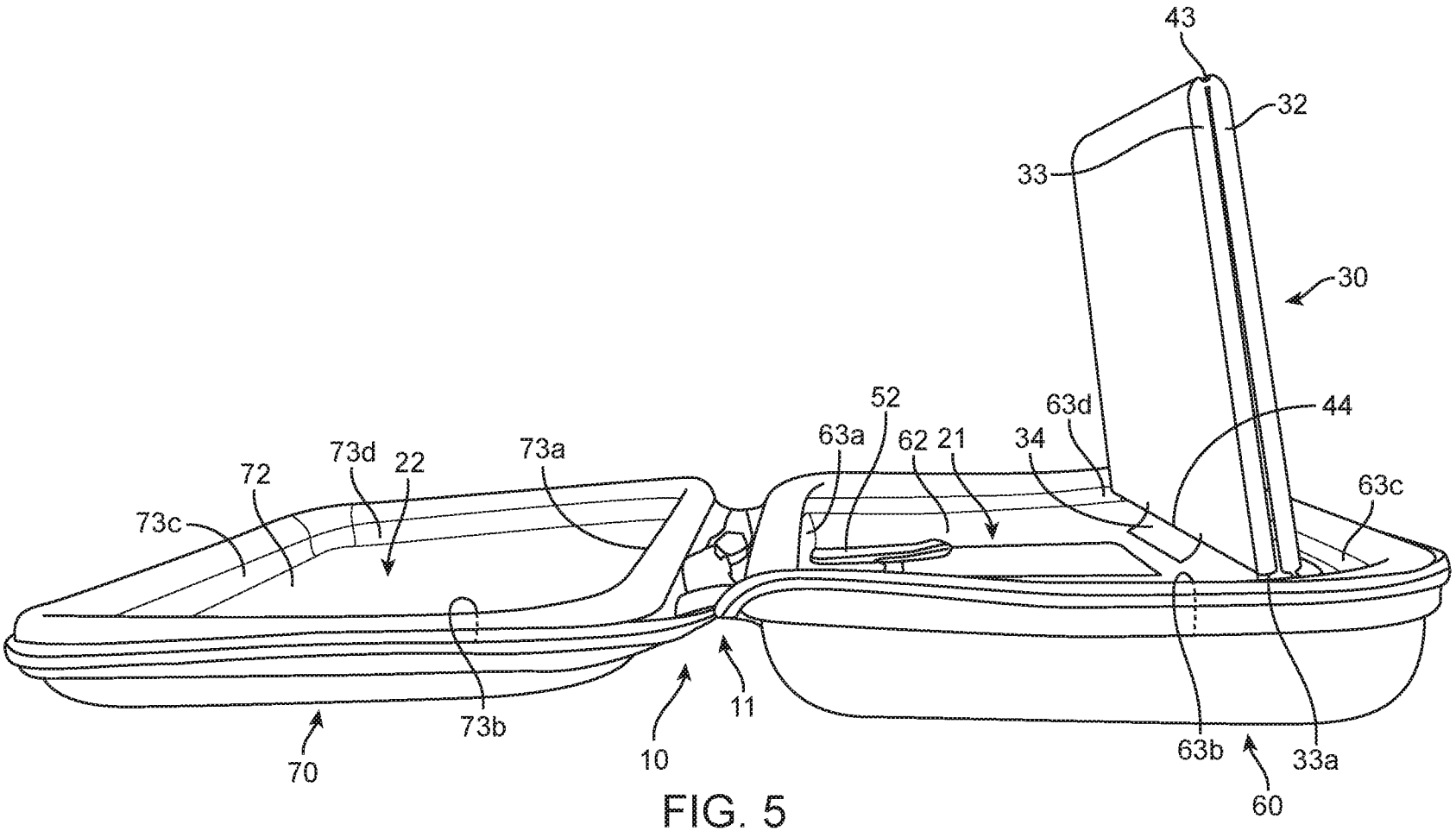
FIG. 5 shows a side view of the case and adjustable viewing stand of FIG. 3 where two panels of the stand are folded against one another and have been rotated away from the case.
Figure 6:
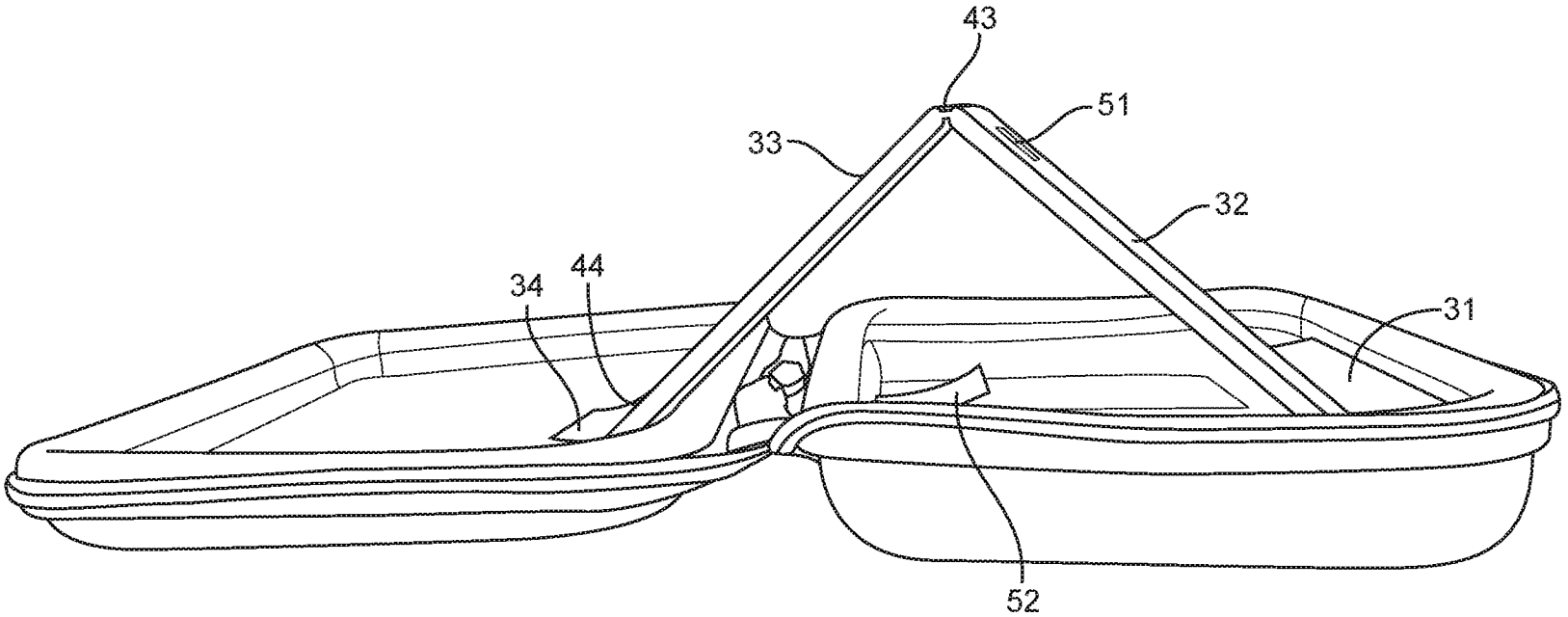
FIG. 6 shows the case and adjustable viewing stand of FIG. 5 where two panels of the stand have been partially unfolded and the stand extends from a first well of the case to a second well of the case.

As seen in FIG. 5, one embodiment of a carrying case 10 has an overall configuration of a bottom portion 60 and a top portion 70 connected to one another by a case hinge 11. As seen in FIG. 1, a zipper 12 runs around the perimeter 13 of this carrying case 10 and is used to keep the carrying case 10 closed. The bottom portion 60 of this carrying case 10 has a first well 21 formed by a first inner surface 62 of the bottom portion 60 where the first inner surface 62 is connected to first walls 63*a*, 63*b*, 63*c*, and 63*d* that form a perimeter around the first inner surface 62. Also in this embodiment which is shown in FIG. 5, the top portion 70 of this carrying case 10 has a second well 22 formed by a second inner surface 72 of the top portion 70 where the second inner surface 72 is connected to second walls 73*a*, 73*b*, 73*c*, and 73*d* that form a perimeter around the second inner surface 72. In an alternative embodiment, the first well 21 and/or the second well 22 are eliminated.

Figure 3:
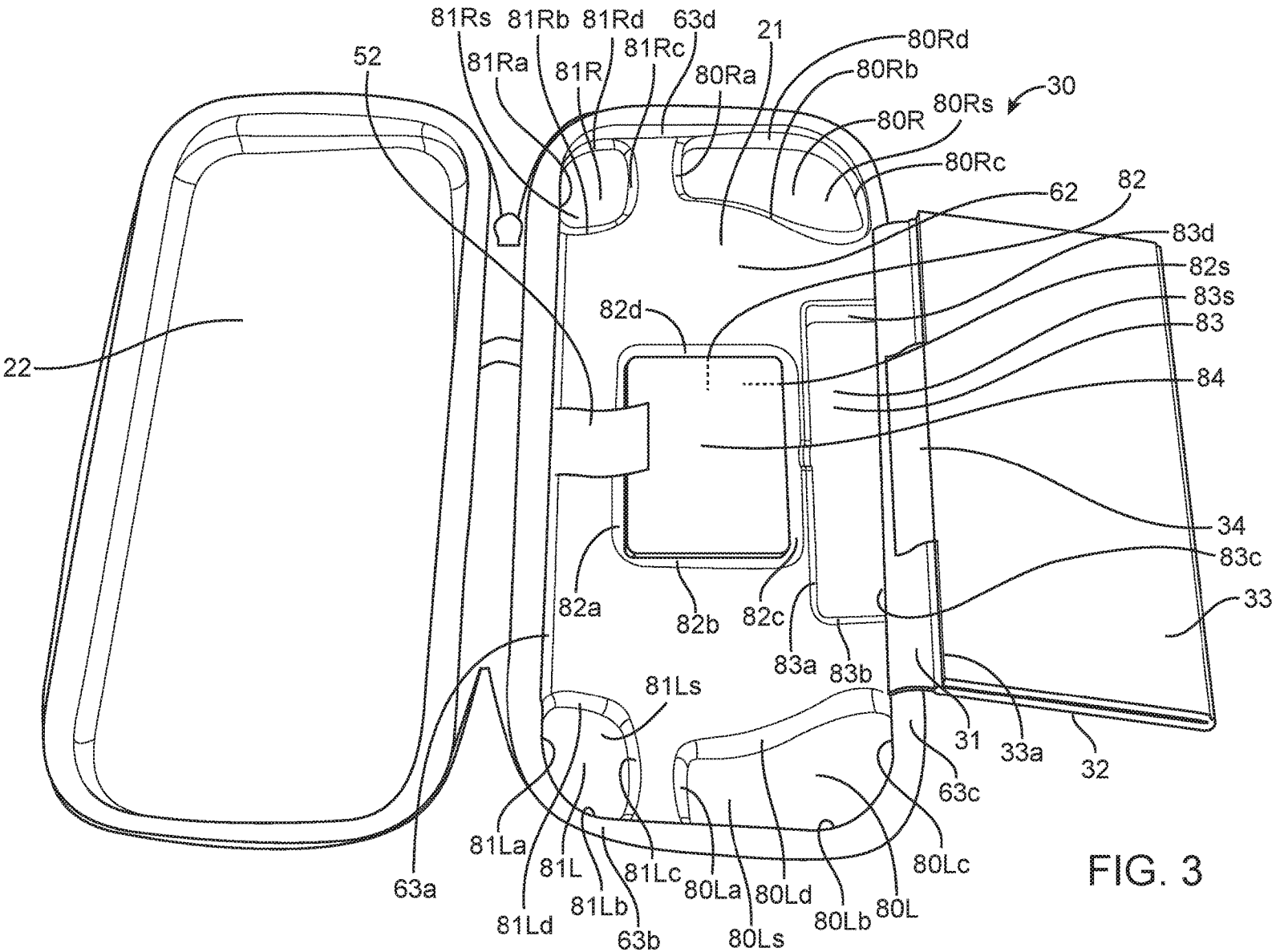
FIG. 3 shows the case of FIG. 1 where the case is open, the adjustable viewing stand is in a folded configuration and has been rotated away from the case, and the electronic device has been removed.

As seen in FIG. 3, the first well 21 may optionally include one or more outer subwells 80L, 80R, 81L, 81R and/or one or more central subwells 82, and/or 83, each of which comprises a lower surface 80Ls, 80Rs, 81Ls, 81Rs, 82*s*, 83*s* connected, respectively, to lower walls 80La, 80Lb, 80Lc, 80Ld, 80Ra, 80Rb, 80Rc, 80Rd, 81La, 81Lb, 81Lc, 81Ld, 81Ra, 81Rb, 81Rc, 81Rd, 82*a*, 82*b*, 82*c*, 82*d*, 83*a*, 83*b*, 83*c*, 83*d* which are, in turn, connected to the inner surface 62 of the first well 21. For orientation purposes, the open carrying case 10 shown in FIG. 3 is how the case 10 would appear resting on a horizontal surface, facing up. In this orientation, a person who uses the electronic device 20 would be located closest to the first well 21 and farthest from the second well 22 such that outer subwells 80L, 81L are located on the left-hand side of the first well 21 and outer subwells 80R, 81R are located on the right-hand side of the first well 21. Also in this orientation the lower surfaces 80Ls, 80Rs, 81Ls, 81Rs 82*s*, 83*s* are each lower in elevation than the first inner surface 62. In lieu of four lower walls 80La, 80Lb, 80Lc, 80L(d), 80Ra, 80Rb, 80Rc, 80Rd, 81La, 81Lb, 81Lc, 81Ld, 81Ra, 81Rb, 81Rc, 81Rd, 82*a*, 82*b*, 82*c*, 82*d*, 83*a*, 83*b*, 83*c*, 83*d*, each outer subwell 80L, 80R, 81L, 81R, and each central subwell 82, 83 can optionally be formed by two, three, five or more lower walls. FIG. 3 also shows an optional card case 84 having dimensions that allow it to fit in central subwell 82.

The primary purpose of the left and right outer subwells 80L, 80R, 81L, 81R is to accommodate feet that may extend from the backside of the electronic device 20. The outer subwells 80L, 80R, 81L, 81R allow the electronic device 20 to be more evenly supported by the inner surface 62 than without the outer subwells 80L, 80R, 81L, 81R. Without the outer subwells 80L, 80R, 81L, 81R, the feet that extend from the backside of the electronic device 20 would bear most of the weight of the electronic device 20 when it is resting on the inner surface 62. The outer subwells 80L, 80R, 81L, 81R allow the electronic device 20 to rest on the inner surface 62 in such a manner that the inner surface 62 can provide support to the backside of the electronic device 20 that it would otherwise not provide.

An electronic device 20 typically has on its backside either no feet, two feet, or four feet. When two feet are present, one such foot is typically located in the top, left corner of the backside and the other foot is typically located in the top, right corner of the backside. The top of the backside is that region of the backside that is the highest elevated portion of the electronic device 20 when the electronic device 20 is in use in the adjustable stand as shown in FIG. 7.

In an alternate version of an electronic device 20 having two feet, each such foot spans the distance between each of the two left corners of the electronic device 20 and the other such foot spans the distance between each of the two right corners of the electronic device 20. See FIG. 8 for an example in this regard which shows only two outer subwells 85L, 85R but can accommodate an electronic device 20 having two feet, four feet or no feet. When four feet are present, one foot is typically located in each corner of the backside of the electronic device 20.

Figure 8:
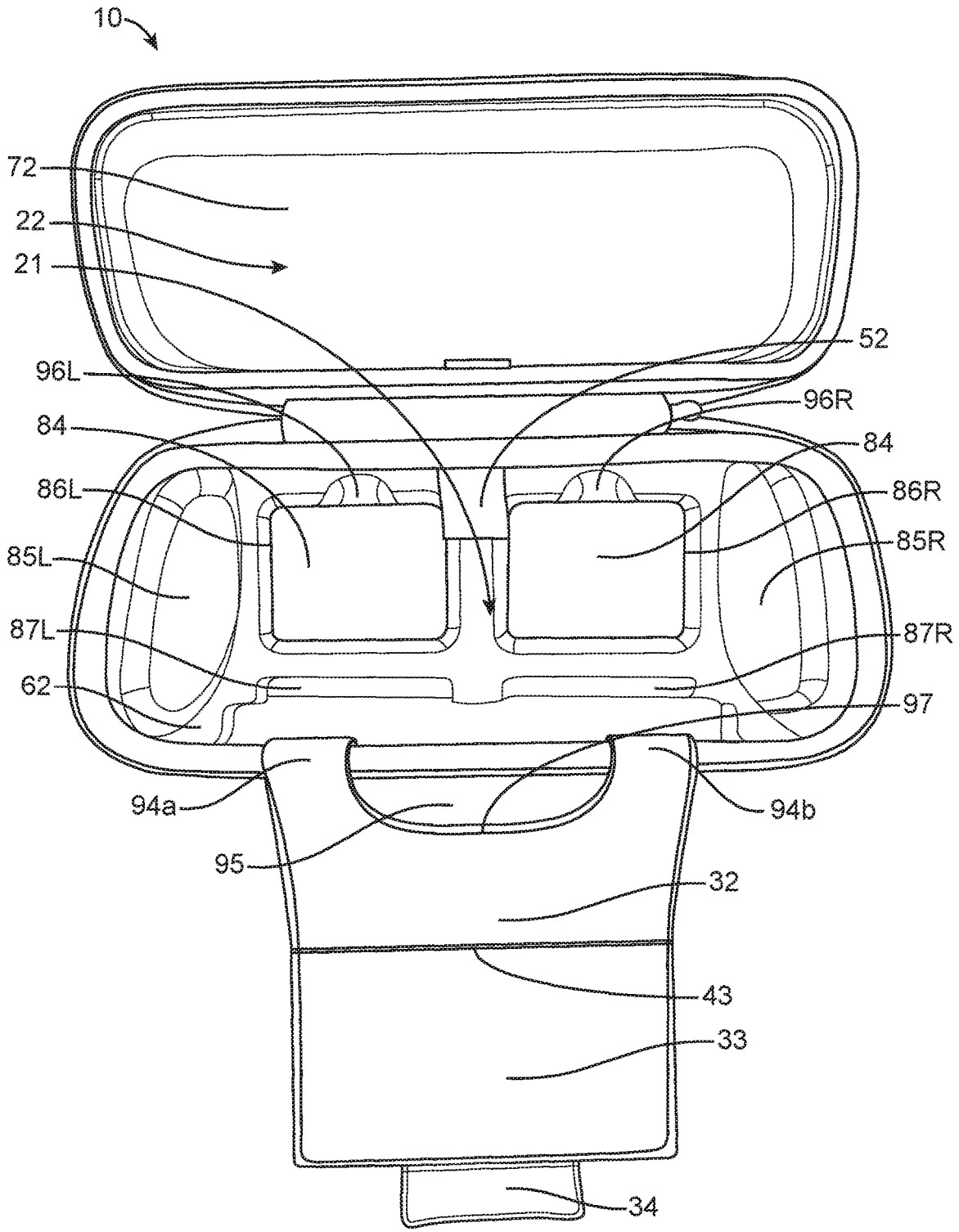
FIG. 8 is a top view of an alternative embodiment of a carrying case where the case is open and facing up, the stand has been unfolded and laid flat on the supporting surface, and the carrying case has two outer subwells and four central subwells.
Figure 9:
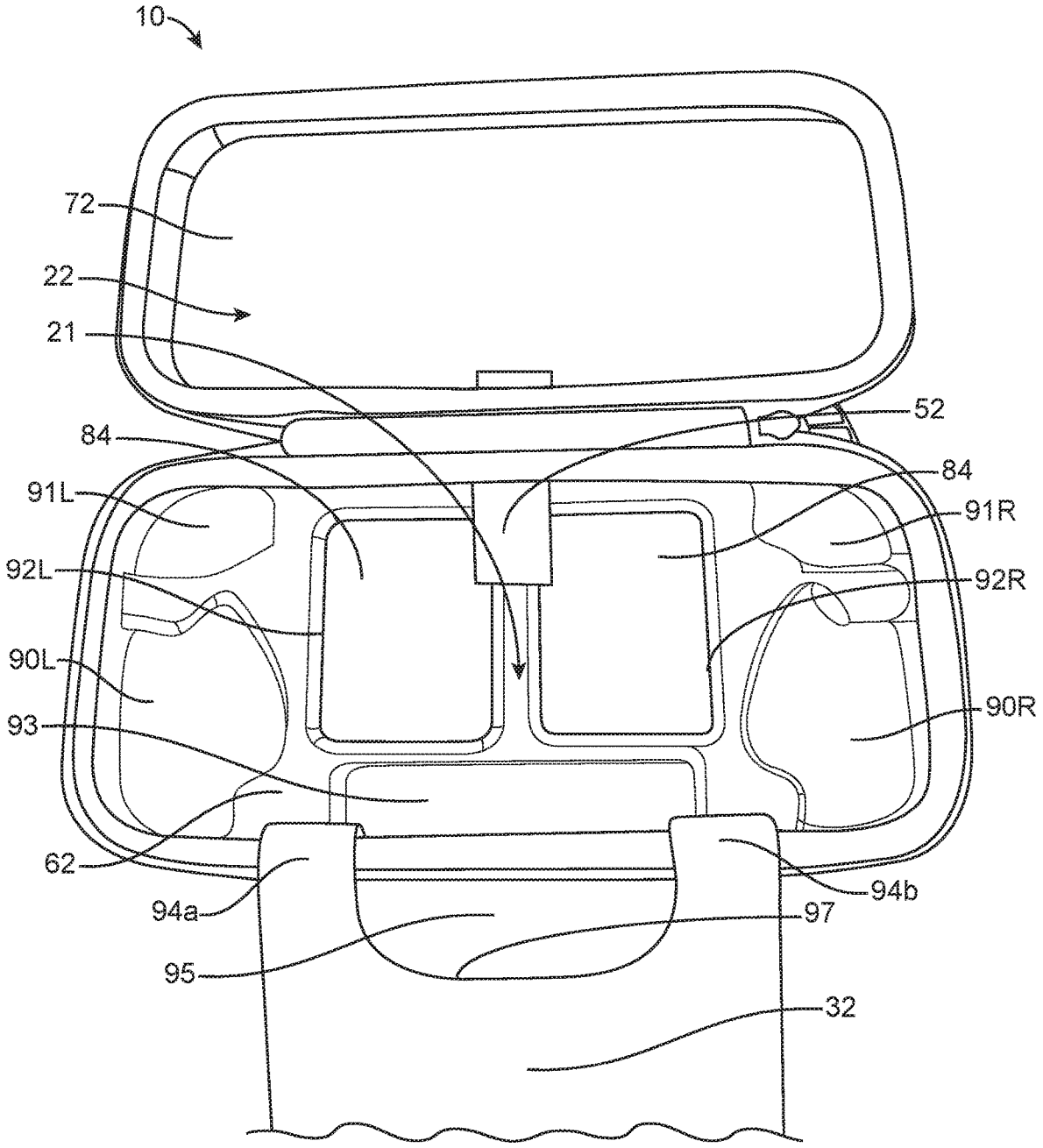
FIG. 9 is a top view of a second alternative embodiment of a carrying case where the case is open and facing up, the stand has been unfolded and laid flat on the supporting surface, and the carrying case has four outer subwells and three central subwells.

The number, location, and shape of the outer subwells 80L, 80R, 81L, 81R can be configured to accommodate one or more differing configurations of the feet of one or more electronic devices 20. For example, FIG. 9 shows four outer subwells 90L, 90R, 91L, 91R each having a different shape than the shape of the outer subwells 80L, 80R, 81L, 81R shown in FIG. 3. An outer subwell 80L, 80R, 81L, 81R need not share any portion of its lower walls 80La, 80Lb, 80Lc, 80Ld, 80Ra, 80Rb, 80Rc, 80Rd, 81La, 81Lb, 81Lc, 81Ld, 81Ra, 81Rb, 81Rc, 81Rd with any portion of any one or more of the first walls 63*a*, 63*b*, 63*c*, and 63*d*, such as is shown in FIG. 3, in order to be within the scope of the instant invention. The same is true for any other carrying case 10 embodiments having outer subwells or central subwells—the lower walls of any outer subwell(s) and/or central subwell(s) need not directly connect with any first walls in order to be within the scope of the instant invention. Although all FIGS. 1-10 show outer subwells having lower walls where a portion of those lower walls is coextensive with the first walls of the bottom portion, outer subwells and/or central subwells formed exclusively by their own lower walls and having nothing coextensive with any first walls are within the scope of the instant invention. Additionally, a carrying case 10 need not have any outer subwell or central subwell in order to be within the scope of the instant invention.

As seen in FIG. 3, the central subwell 82 is located equidistant between the left side and the right side of the bottom portion 60. In this middle position between the left and right sides of the bottom portion 60, approximately half of the central subwell 82 is located in the left side of the inner surface 62 and the remainder of the central subwell 82 is located in the right side of the inner surface 62. In alternative embodiments, the inner surface 62 may have two or more central subwells 86L, 86R, 87L, 87R as shown in FIG. 8 and 92L, 92R, 93 as shown in FIG. 9. As shown in FIG. 9, one central subwell 92L is located to the immediate left of the middle of the inner surface 62, a second central subwell 92R is located to the immediate right of the middle of the inner surface 62, and a third central subwell 93 is centered about the midpoint of the inner surface 62. FIG. 8 also shows optional access notches 96L, 96R that provide room for a person's fingertips to press against a side of the card case 84 to facilitate the removal of the card case 84 from the central subwells.

Figure 4:
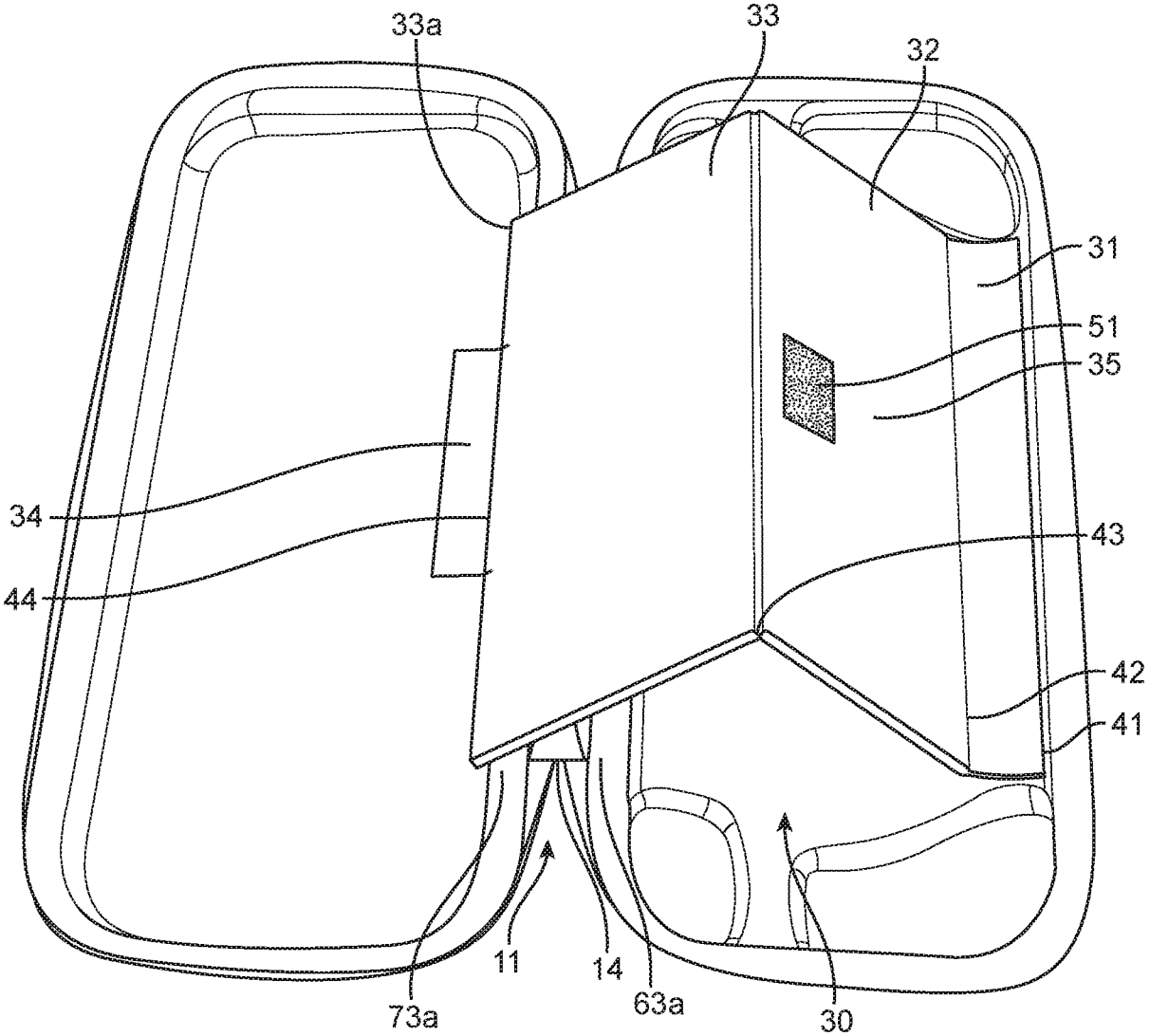
FIG. 4 shows the case and adjustable viewing stand of FIG. 3 where the adjustable viewing stand is partially unfolded and extends from a first well of the carrying case into a second well of the carrying case.

The case hinge 11 may be formed by a strip of material 14 attached to the first wall 63*a* and the second wall 73*a* as shown in FIG. 4. Alternatively, the case hinge 11 may be formed by attaching the first wall 63*a* to second wall 73*a*. This attachment of the first wall 63*a* to the second wall 73*a* can be by, for example, zipper, stitching or hook and loop.

In one embodiment, the adjustable viewing stand 30 comprises an edge strip 31, one end of which is fixedly and hingably attached to a first well 21 of the carrying case 10 via a first hinge 41, the opposing end of the edge strip 31 is fixedly and hingably attached to one end of a first panel 32 via a second hinge 42. The opposing end of the first panel 32 is fixedly and hingably attached to one end of a second panel 33 via a third hinge 43. The opposing end of the second panel 33 is fixedly and hingably attached to one end of an adjustment tab 34 via a fourth hinge 44. The adjustment tab 34 can be locked in position in a second well 22 of the carrying case 10 by hook and loop fastener material located on the adjustment tab 34 and on the second inner surface 72 of the second well 22.

In an alternative embodiment, the edge strip 31 is removably attached to the first well 21 of the carrying case 10 by hook and loop fasteners (not shown). In each of these embodiments, the edge strip 31 may be attached to the carrying case 10 via the first wall 63*c* in lieu of being attached to the first well 21. Alternatively, in each of these embodiments the edge strip 31 may be attached to the carrying case 10 in the region of the juncture 66*c* which is the juncture formed where the first inner surface 62 meets the first wall 63*c*.

Figure 10:
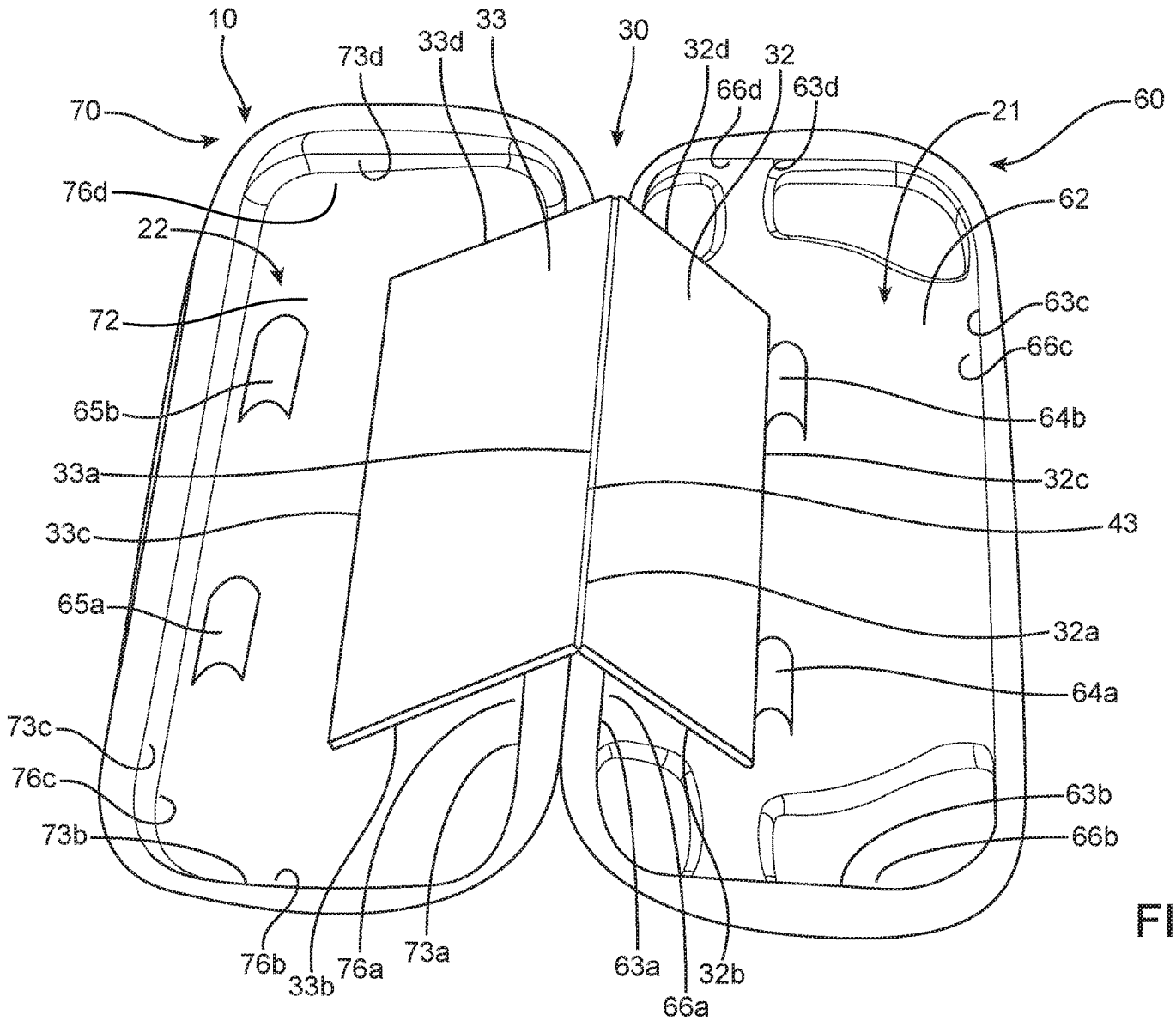
FIG. 10 is a top view of a third alternative embodiment of a carrying case where the case is open and facing up and the stand comprises two panels and is mounted in the case.

In another alternative embodiment, an example of which is shown in FIG. 10, the viewing stand 30 has a size and shape that allows it to be stored in the carrying case 10, but is not fixedly connected to the carrying case 10. In this embodiment, the viewing stand 30 is instead an integral, dedicated component of the carrying case 10. In this embodiment, the viewing stand 30 is mountable in the carrying case 10 and comprises a first panel 32 hingably connected to a second panel 33. The first panel 32 in this embodiment is mountable in the first well 21 or second well 22 while simultaneously the second panel 33 is also mountable in the first well 21 or second well 22. As shown in FIG. 10, first panel 32 comprises panel edges 32*a*, 32*b*, 32*c*, and 32*d* and second panel 33 comprises panel edges 33*a*, 33*b*, 33*c*, and 33*d*. Panel 32 and 33 and other panels may comprise additional panel edges or fewer panel edges. The second hinge 42 that would otherwise be connected to panel edge 33*c* is eliminated and that edge 32*c* is instead held in place during viewing operations by mounting it, for example, at or in the region of juncture 66*c*. In lieu of juncture 66*c*, panel edge 32*c* could instead be mounted, at least in part, on an inner surface 62 or 72 by friction, hook and loop or other restraint such as one or more edge stops. As used herein, an edge stop is anything that can stop a panel edge 32*a*, 32*b*, 32*c*, 32*d*, 33*a*, 33*b*, 33*c*, or 33*d* from moving in at least one direction. Examples of edge stops include a change in elevation of the inner surface 62 or 72 either by raising it such as shown in the edge stops 64*a*, 64*b*, 65*a*, 65*b* in FIG. 10 or by lowering that elevation to form a trough (not shown) in which a panel edge 32*a*, 32*b*, 32*c*, 32*d*, 33*a*, 33*b*, 33*c*, or 33*d* could fit. Additional examples of edge stops include any material having a size, shape, location and orientation that allow it to prevent movement of a panel edge 32*a*, 32*b*, 32*c*, 32*d*, 33*a*, 33*b*, 33*c*, or 33*d* in at least one direction or any structure that performs that function. In the example shown in FIG. 10, each edge stop 64*a*, 64*b*, 65*a*, 65*b* constitutes four separate changes in elevation since each such edge stop 64*a*, 64*b*, 65*a*, 65*b* occupies one of four distinct locations. Additionally, edge stops 64*a*, 64*b*, 65*a*, 65*b* are not limited to the shapes, sizes, locations, and number of edge stops shown in FIG. 10. Instead, this embodiment includes a carrying case 10 that has only one edge stop 64*a*, 64*b*, 65*a*, or 65*b* or otherwise. This embodiment also includes a carrying case 10 that has two or more edge stops 64*a*, 64*b*, 65*a*, or 65*b* or otherwise, even if all of those two or more edge stops occur only in the bottom portion 60 or only in the top portion 70. In this embodiment, as in all other embodiments, the viewing stand 30 may, or may not, have an adjustment tab 34. In the example embodiment shown in FIG. 10, the adjustment tab 34 has been eliminated. Panel edge 32*a* is connected to panel edge 33*a* via hinge 43. Hinge 43, like any other hinge in this invention, is typically not a separate component from any panels that are connected together by a hinge. Instead, any hinge in this invention exists at least where two panels are foldable with respect to one another.

In the embodiment shown in FIG. 10, panel edge 33*c*, and by extension second panel 33, is mounted and held in place in the second well 22 by friction. As used here, friction is the resistance of a first material to slide with respect to, and due to contact with, a second material. The first and second materials comprise any natural or synthetic components. The first material may be identical to the second material. For example, the first and second materials may both be, or comprise, microfiber cloth. As another example, the first material may be, or comprise, microfiber cloth and the second material may be, or comprise, terrycloth. By way of example only and not by way of limitation, other materials that can provide friction, whether with themselves or with a different second material, include canvas, fleece, flannel, corduroy, muslin, felt, burlap, polyester, wool, cotton, and denim. In lieu of or in addition to one or more edge stops 64*a*, 64*b*, 65*a*, or 65*b* or otherwise or friction, first panel 32 and second panel 33 can also be mounted and held in place in the carrying case 10 by having one of their unhinged panel edges 32*b*, 32*c*, 32*d*, 33*b*, 33*c*, or 33*d* placed at, or in the region of, a juncture. A juncture is formed where an inner surface 62 or 72 meets a first wall 63*a*, 63*b*, 63*c*, 63*d*, 73*a*, 73*b*, 73*c*, or 73*d*. As shown in FIG. 10, these inner surfaces 62 and 72 and first walls 63*a*, 63*b*, 63*c*, 63*d*, 73*a*, 73*b*, 73*c*, and 73*d* form eight junctures 66*a*, 66*b*, 66*c*, 66*d*, 76*a*, 76*b*, 76*c*, 76*d*. Panel edges 32*c*, 33*c* can also be mounted in the carrying case 10 and held in place by hook and loop material placed along either one or both of panel edges 32*c* and/or 33*c* and on inner surface 62 and/or inner surface 72. By way of example only, as shown in FIG. 10, in lieu of or in addition to friction and/or hook and loop, panel edge 33*c* could be mounted and held in place in the top portion 70 by being positioned so that it abuts against edge stops 65*a*, 65*b* or by instead positioning it so that it is mounted and held in place by juncture 76*c*.

In another alternative embodiment, the edge strip 31 is eliminated and the viewing stand 30 is connected to the carrying case 10 by way of hingably attaching the first panel 32 to first inner surface 62, to first wall 63*c* or at, or in the region of, juncture 66*c*. The adjustment tab 34 may also be eliminated in this or any other embodiment. In this embodiment, the second panel 33 is hingably connected to the first panel 32. For purposes of maintaining any particular viewing angle in this embodiment, as in any other applicable embodiment, the panel edge 33*c* may be held in place by any of the means described in the embodiment shown in FIG. 10, i.e., by friction, hook and loop, edge stop or juncture.

Figure 2:
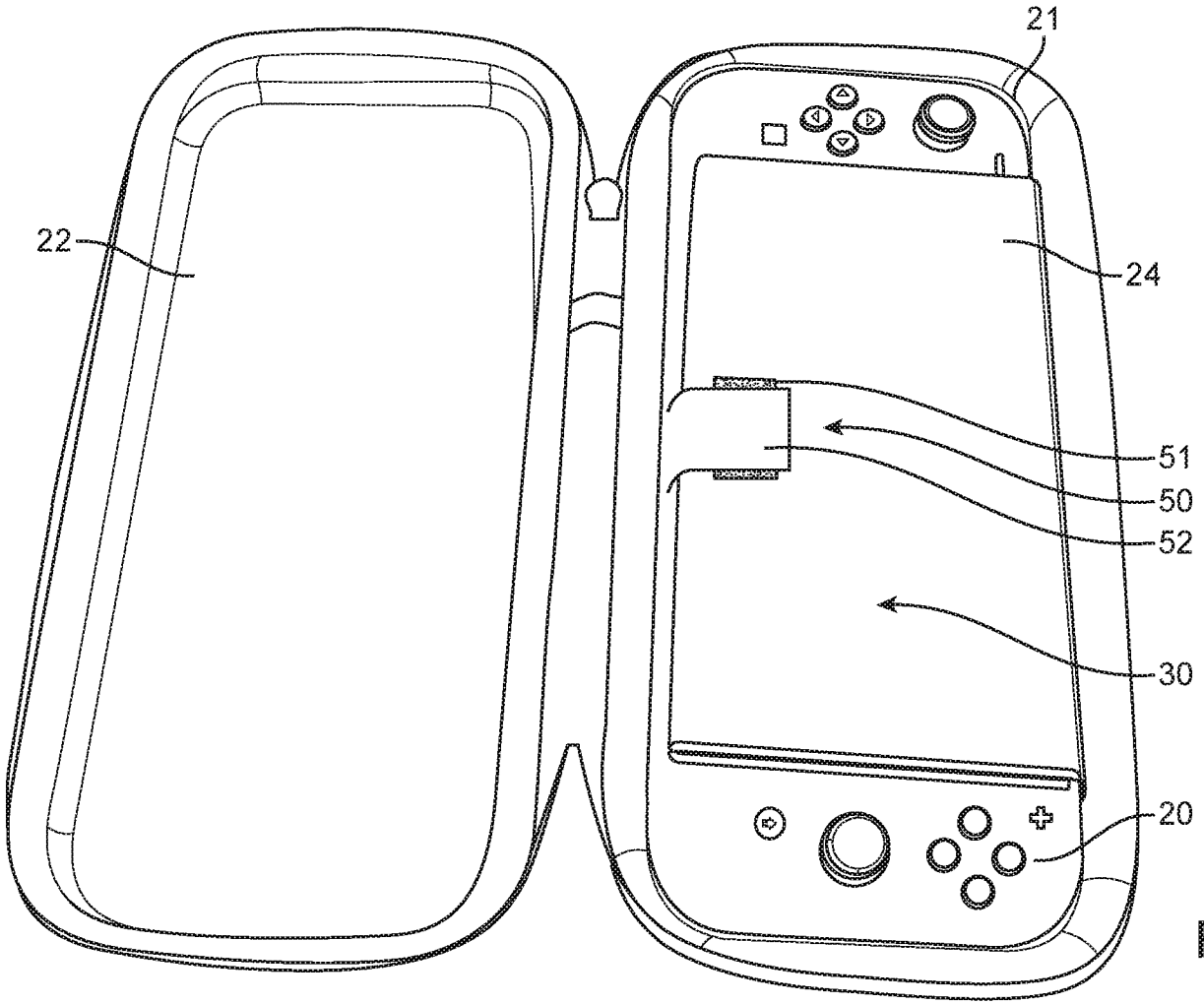
FIG. 2 shows the case of FIG. 1 where the case is open, an adjustable viewing stand is in a folded configuration, and an electronic device is underneath the viewing stand.

As shown in FIGS. 2 and 5, when the electronic device 20 is not in use, it can be stored between the viewing stand 30 and the first inner surface 62 of the bottom portion 60. In an alternative embodiment, the edge strip 31 or first panel 32 of the viewing stand 30 is hingably attached to the first inner surface 62 in such a manner that, when not in use, the viewing stand 30 is stored immediately adjacent to the first inner surface 62 and the electronic device 20 is stored on the opposite side of the viewing stand 30.

In the embodiments shown in FIGS. 8 and 9, edge strip 31 has been eliminated and replaced with edge pieces 94*a*, 94*b* which are separated by a cutout 95. Cutout 95 is an open-air region that would otherwise be occupied by the first panel 32. Cutout 95 is formed at least in part by a cutout edge 97 that extends into first panel 32. Edge pieces 94*a*, 94*b* are connected to the carrying case 10 and to first panel 32 in all the same ways that edge strip 31 can be connected to the carrying case 10 and to the first panel 32. When the viewing stand 30 includes an adjustment tab 34, the cutout 95 allows the second panel 33 to fold flush against the first panel 32 by allowing the adjustment tab 34 to occupy the open-air region of the cutout 95.

When the stand 30 is not in operation, it can be folded as shown in FIGS. 2, 3 and 5. The width of the edge strip 31 may have a width that corresponds to the width of the electronic device 20 to allow the stand 30 to fold over the electronic device 20. The width of the electronic device 20 is generally defined by its thickness between its viewing surface and the surface opposite thereto which is the surface of its backside. The stand 30 is locked in this position via a closure lock 50. The closure lock 50 comprises a closure pad 51 located on the viewing surface 35 of the stand 30. The closure lock 50 includes a closure tab 52 fixedly connected to a first well 21 of the carrying case 10. As shown in FIG. 2, the closure pad 51 and closure tab 52 each have hook and loop fasteners that fasten to one another by being pressed together by hand or finger. Fastening of the closure pad 51 and closure tab 52 in this manner locks the stand 30 in place around the electronic device 20. The viewing screen of the electronic device 20 is protected when the stand 30 is folded. In this locked position, the carrying case 10 can be closed and transported.

In the operation of one embodiment of the stand 30, the carrying case 10 is opened, the closure tab 52 is unlocked, and the first panel 32 and second panel 33 remain substantially in contact with one another while they are rotated on second hinge 42 away from the electronic device 20. The electronic device 20 is then removed from the carrying case 10. The first panel 32 and second panel 33 are then unfolded from one another in such a manner and to such a degree that the viewing surface 35 is at the desired angle. The adjustment tab 34 is then locked in place in the second well 22 of the carrying case 10 by pressing its hook and loop fastener against the second inner surface 72 of the second well 22. The electronic device 20 may now be placed on the viewing surface 35. The edge strip 31, along with its attachment location in the first well 21, forms a long, narrow trough to hold the electronic device 20 in place while in use and at the same time allows the electronic device 20 to be rotated to different viewing angles if so desired.

In an alternative embodiment, the edge strip 31 could be eliminated. In another alternative embodiment, the number of panels could be three. In any given embodiment, the stand 30 need not be connected to the carrying case. With respect to the hook and loop fastener in the attachment tab 34 and the second inner surface 72 of the second well 22, any two materials that are resistant to sliding against one another could be used in lieu thereof.

Each panel may be a single sheet or material (such as plastic, cardboard, metal, wood, treated fabric, rubber, resin, polyurethane, a composite or the like) having sufficient rigidity or stiffness to support an electronic device 20.

The invention may be made using known methods and technologies in the manufacture of carrying cases and viewing stands.

The invention disclosed herein is not limited to the specific embodiments described herein. The disclosed embodiments may be modified or have elements deleted or added while still remaining within the scope of this invention. The invention is described herein by way of example only and is not limited to the disclosed example(s) or embodiment(s). Similarly, the figures are provided as examples of the invention and to aid in understanding the invention and not to act as a limitation on the scope of the invention. Each limitation is expressly defined as not being limited to what is shown in the figures. The embodiments disclosed herein may be modified by those skilled in the art without departing from the scope of the invention.

While the foregoing detailed description sets forth a number of embodiments of a carrying case with adjustable viewing stand in accordance with the present invention, the above description is illustrative only and not limiting of the disclosed invention.

What is claimed is:

1. A carrying case for an electronic device, the carrying case comprising:

a bottom portion and a top portion, the bottom portion having an inner surface, the bottom portion and top portion closable with respect to one another, at least two subwells in the inner surface, at least one of said at least two subwells adapted to receive at least a portion of the electronic device when the bottom portion and top portion are closed with respect to one another, an adjustable viewing stand connected to the carrying case, the adjustable viewing stand configurable to support the electronic device, the adjustable viewing stand comprising at least two hingably connected panels, one of the at least two hingably connected panels having a viewing surface and the at least two hingably connected panels adapted to be foldable so as to fit inside the carrying case, and a closure tab attached to either the top or bottom portion of the inner surface of the carrying case and adapted to releasably lock said at least two hingably connected panels when said panels are folded to fit inside the carrying case.

2. The invention of claim 1 wherein the bottom portion has a first well and the top portion has a second well.

3. The invention of claim 2 wherein the carrying case has a case hinge.

4. The invention of claim 2 wherein one panel of the adjustable viewing stand is attached to the first well.

5. The invention of claim 2 wherein the bottom portion has a wall and the adjustable viewing stand is attached to the wall.

6. A carrying case for an electronic device, the carrying case comprising:

a bottom portion and a top portion, the bottom portion having an inner surface and a first well, the bottom portion and top portion closable with respect to one another, at least two central subwells in the inner surface, at least one of said at least two central subwells adapted to receive at least a portion of the electronic device when the bottom portion and top portion are closed with respect to one another, an adjustable viewing stand connected to the carrying case, the adjustable viewing stand configurable to support the electronic device, the adjustable viewing stand comprising at least two hingably connected panels, one of the at least two hingably connected panels having a viewing surface and the at least two hingably connected panels adapted to be foldable so as to fit inside the carrying case, and a closure tab attached to either the top or bottom portion of the inner surface of the carrying case and adapted to releasably lock said at least two hingably connected panels when said panels are folded to fit inside the carrying case.

7. The invention of claim 6 wherein one panel of the adjustable viewing stand is attached to the first well.

8. The invention of claim 6 wherein the first well has a wall and the adjustable viewing stand is attached to the wall.

9. A carrying case for an electronic device, the carrying case comprising:

a bottom portion and a top portion, the bottom portion having an inner surface, the bottom portion and top portion closable with respect to one another, at least two subwells in the inner surface, at least one of said at least two subwells adapted to receive at least a portion of the electronic device when the bottom portion and top portion are closed with respect to one another, an adjustable viewing stand mountable in the carrying case, the adjustable viewing stand configurable to support the electronic device, the adjustable viewing stand comprising at least two hingably connected panels, one of the at least two hingably connected panels having a viewing surface and the at least two hingably connected panels having a size and shape adapted to be foldable so as to fit inside the carrying case, and a closure tab attached to either the top or bottom portion of the inner surface of the carrying case and adapted to releasably lock said at least two hingably connected panels when said panels are folded to fit inside the carrying case.

10. The invention of claim 9 wherein the top portion has an inner surface attached to at least two walls, the inner surface of the bottom portion is attached to at least two walls, the region where the top or bottom inner surface meets a wall is a juncture, and at least one of the at least two hingably connected panels has at least one edge that is mountable at or near a juncture.

11. The invention of claim 9 wherein the top portion has an inner surface, at least one edge stop is located on the inner surface of the top portion and/or the inner surface of the bottom portion, and at least one of the at least two hingably connected panels has at least one panel edge that is mountable at said at least one edge stop.

12. The invention of claim 9 wherein the top portion has an inner surface and at least one of the at least two hingably connected panels has at least one edge that is mountable on the inner surface of the top portion or the inner surface of the bottom portion by friction.

13. The invention of claim 9 wherein the top portion has an inner surface and at least one of the at least two hingably connected panels has at least one edge that is mountable on the inner surface of the top portion or the inner surface of the bottom portion by hook and loop material.

* * * * *